US007594325B2

(12) United States Patent
Read

(10) Patent No.: US 7,594,325 B2
(45) Date of Patent: Sep. 29, 2009

(54) AEROFOIL AND A METHOD OF MANUFACTURING AN AEROFOIL

(75) Inventor: Simon Read, Derby (GB)

(73) Assignee: Rolls-Royce plc, London (GB)

( * ) Notice: Subject to any disclaimer, the term of this patent is extended or adjusted under 35 U.S.C. 154(b) by 665 days.

(21) Appl. No.: 11/210,872

(22) Filed: Aug. 25, 2005

(65) Prior Publication Data

US 2007/0243069 A1 Oct. 18, 2007

(30) Foreign Application Priority Data

Sep. 22, 2004 (GB) ..... 0421033.2

(51) Int. Cl.
*B21D 53/78* (2006.01)
*B63H 1/26* (2006.01)
*B22F 3/00* (2006.01)

(52) U.S. Cl. ..... 29/889.71; 29/889; 29/889.72; 416/229 R; 416/232; 428/547; 428/548; 428/550

(58) Field of Classification Search ..... 29/889, 29/889.21, 889.6, 889.71, 889.72; 416/229 R, 416/232; 428/547–548, 550
See application file for complete search history.

(56) References Cited

U.S. PATENT DOCUMENTS

| | | | | |
|---|---|---|---|---|
| 3,567,407 | A | 3/1971 | Yoblin | |
| 4,327,154 | A * | 4/1982 | Rossmann | 428/545 |
| 4,440,834 | A | 4/1984 | Aubert et al. | |
| 4,626,172 | A | 12/1986 | Mouille et al. | |
| 5,139,887 | A | 8/1992 | Sutton | |
| 5,248,242 | A | 9/1993 | Lallo et al. | |
| 5,363,555 | A * | 11/1994 | Fowler et al. | 29/889.72 |
| 5,634,189 | A | 5/1997 | Rossmann et al. | |
| 5,634,771 | A * | 6/1997 | Howard et al. | 416/241 A |
| 5,896,658 | A | 4/1999 | Calle et al. | |
| 6,669,447 | B2 * | 12/2003 | Norris et al. | 416/224 |
| 2003/0185685 | A1 | 10/2003 | Simon | |
| 2007/0122606 | A1 | 5/2007 | Meier et al. | |
| 2008/0118355 | A1 | 5/2008 | Buttner et al. | |
| 2008/0250641 | A1 * | 10/2008 | James et al. | 29/889.71 |

FOREIGN PATENT DOCUMENTS

| | | |
|---|---|---|
| GB | 1 228 996 | 4/1971 |
| GB | 2 280 867 | 2/1995 |
| GB | 2 289 429 | 11/1995 |
| GB | 2 360 236 A | 9/2001 |
| IT | 1090284 | 10/1977 |
| JP | 2000-168021 | 6/2000 |
| WO | WO 2006/122999 A1 | 11/2006 |

* cited by examiner

*Primary Examiner*—David P Bryant
*Assistant Examiner*—Alexander P Taousakis
(74) *Attorney, Agent, or Firm*—Oliff & Berridge, PLC

(57) ABSTRACT

An aerofoil (35) for example a fan blade (26) comprises a leading edge (36), a trailing edge (38), a concave pressure surface extending (40) from the leading edge (36) to the trailing edge (38) and a convex suction surface (42) extending from the leading edge (36) to the trailing edge (38). The aerofoil (35) comprises a metal foam (50) arranged within a cavity defined by metal workpieces (52, 54). The metal foam (50) of the aerofoil (26) ideally has a density of less than $1 g/cm^3$, is cheaper to manufacture and has improved fatigue behaviour and impact capability.

5 Claims, 1 Drawing Sheet

AEROFOIL AND A METHOD OF MANUFACTURING AN AEROFOIL

The present invention relates to an aerofoil for a gas turbine engine and in particular to a rotor blade or stator vane for a turbofan gas turbine engine casing.

Conventionally the compressor blades and the compressor vanes for a gas turbine engine are solid metal. Conventionally the fan blades for a turbofan gas turbine engine are solid metal. It is known for the fan blades to be made from solid metal walls between which is provided a honeycomb structure to reduce the weight of the fan blades and the fan blade is produced by joining the peripheries of the solid metal walls together by brazing, bonding or welding. It is also known for the fan blades to be made from solid metal walls between which extends a solid metal warren girder structure to reduce the weight of the fan blades, and the fan blade is produced by diffusion bonding and superplastic forming of the solid metal pieces. It is also known for the fan blades to be made from composite material to reduce the weight of the fan blades.

However, there is still a requirement to reduce the weight and/or reduce the manufacturing cost of the metal rotor blades or stator vanes.

Accordingly the present invention seeks to provide a novel aerofoil, which reduces, preferably, overcomes the above-mentioned problems.

Accordingly the present invention provides a metal aerofoil comprising a leading edge, a trailing edge, a concave pressure surface extending from the leading edge to the trailing edge and a convex suction surface extending from the leading edge to the trailing edge, the concave pressure surface and the convex suction surface being defined by an integral solid metal wall and defining a hollow interior, wherein the hollow interior of the metal aerofoil containing a metal foam, the metal foam substantially filling the hollow interior of the metal aerofoil.

Preferably the metal foam comprises aluminium foam, nickel foam, titanium foam, aluminium alloy foam, titanium alloy foam, magnesium alloy foam, nickel alloy foam or steel foam.

Preferably the aerofoil is a rotor blade or a stator vane.

Preferably the rotor blade is a fan blade or a compressor blade.

Preferably the stator vane is a fan outlet guide vane or a compressor vane.

Preferably the aerofoil, except for the solid metal portion, ideally has a density of less than 1 g/cm$^3$. Alternatively the aerofoil, except for the solid metal portion, may have a density greater than 1 g/cm$^3$.

The metal foam may comprise hollow metal microspheres or hollow metal nanospheres. The metal foam may comprise a syntactic metal foam or a sintered metal foam.

The present invention also provides a method of manufacturing an aerofoil comprising the steps of: a) forming a metal foam preform, b) forming at least two metal workpieces, c) placing the metal foam preform between the at least two metal workpieces in an aerofoil shaped mould, d) bonding the metal foam preform and the at least two metal workpieces together in the aerofoil shaped mould to form an aerofoil.

Preferably step (d) comprises diffusion bonding. Alternatively step (d) comprises brazing. Alternatively step d) comprises adhesive bonding or welding.

The metal foam may be produced by injecting gas into a molten metal, applying heat to a metal powder mixed with a foaming agent, bonding metal microspheres or metal nanospheres together using a syntactic foam e.g. metal matrix, sintering hollow metal spheres or sintering a mixture of metal powder and a space holder and then burning out the space holder.

The present invention also provides a method of manufacturing an aerofoil comprising the steps of: a) forming at least two metal workpieces, b) applying a stop off material to one surface of one of the at least two metal workpieces, c) arranging the at least two metal workpieces in a stack with the stop off material between the two metal workpieces, d) sealing the edges of the at least two metal workpieces together to form a sealed assembly, e) evacuating the interior of the sealed assembly, f) heating and applying pressure to diffusion bonding the at least two metal workpieces together except where the stop off has been applied to form an integral structure, heating and pressurising the interior of the integral structure to form a cavity in the integral structure, g) forming a metal foam in the cavity in the integral structure.

Preferably step g) comprises filling the cavity with a metal powder, or hollow metal spheres, and a space holder and sintering the metal powder, or hollow metal spheres, such that the metal powder, or hollow metal spheres, bond together and bond to the at least two metal workpieces.

Alternatively step g) comprises filling the cavity with a molten metal syntactic mixture.

Alternatively step g) comprises filling the cavity with molten metal and injecting gas into the molten metal to form the metal foam.

Alternatively step g) comprises filling the cavity with metal powder and a foaming agent.

Preferably the metal foam comprises aluminium foam, nickel foam, titanium foam, titanium alloy foam, aluminium alloy foam, magnesium alloy foam, nickel alloy foam or steel foam.

Preferably the aerofoil is a rotor blade or a stator vane.

Preferably the rotor blade is a fan blade or a compressor blade.

Preferably the stator vane is a fan outlet guide vane or a compressor vane.

Preferably step (b) comprises sintering in a vacuum or at inert atmosphere.

Preferably the hollow metal spheres are hollow metal microspheres or hollow metal nanospheres.

The present invention will be more fully described by way of example with reference to the accompanying drawings in which:—

Figure 1:
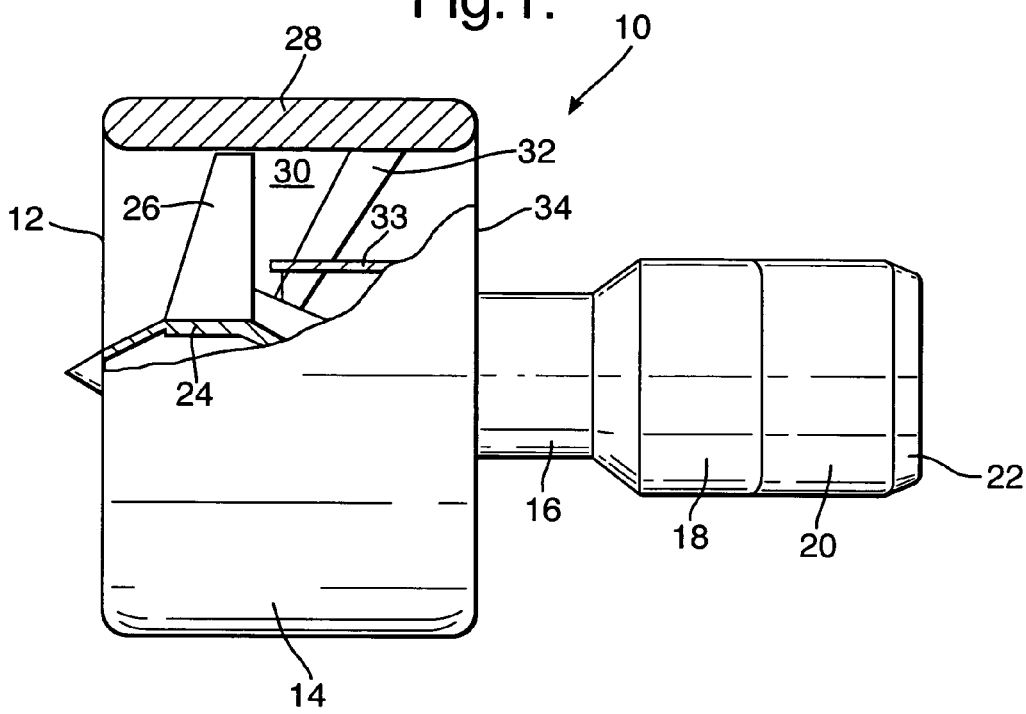
FIG. 1 is a partially cut away view of a turbofan gas turbine engine having an aerofoil according to the present invention.

A turbofan gas turbine engine 10, as shown in FIG. 1, comprises in axial flow series an inlet 12, a fan section 14, a compressor section 16, a combustion section 18, a turbine section 20 and an exhaust 22. The turbine section 20 comprises one or more turbines (not shown) arranged to drive the fan section 14 via a shaft (not shown) and one or more turbines (not shown) arranged to drive one or more compressors (not shown) in the compressor section 16 via one or more shafts (not shown). The fan section 14 comprises a fan rotor 24, which carries a plurality of circumferentially spaced radially outwardly extending fan blades 26. A fan casing 28 surrounds the fan rotor 24 and the fan blades 26 and is arranged coaxially with the fan rotor 24. The fan casing 28 is secured to the core engine casing 33 by a plurality of circumferentially spaced radially extending fan outlet guide vanes 32. The fan casing 28 partially defines a fan duct 30, which has an exhaust 34 at its downstream end.

Figure 2:
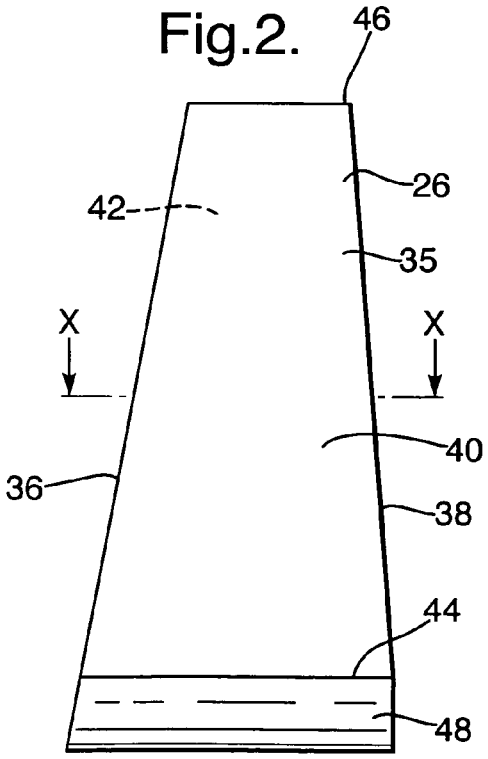
FIG. 2 is an enlarged view of an aerofoil according to the present invention.
Figure 3:
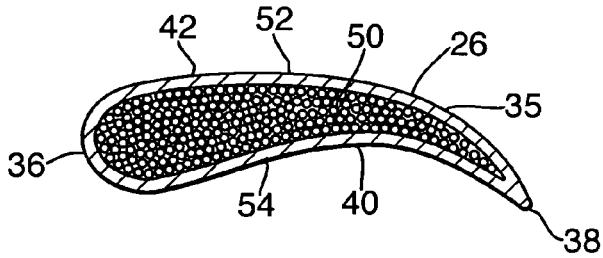
FIG. 3 is a cross-sectional view along the line X-X in FIG. 2.

One of the fan blades 26 is shown more clearly in FIGS. 2 and 3. The fan blade 26 comprises an aerofoil portion 35 and a radially inner end 44 and a radially outer end 46. The aerofoil portion 35 comprises a leading edge 36, a trailing edge 38, a concave pressure surface 40, which extends from the leading edge 36 to the trailing edge 38 and from the radially inner end 44 to the radially outer end 46 and a convex suction surface 42 which extends from the leading edge 36 to the trailing edge 38 and from the radially inner end 44 to the radially outer end 46. The radially inner end 44 comprises a root portion 48, which enables the radially inner end 44 to be secured to the fan rotor 24. The root portion 48 may for example comprise a dovetail root or a firtree root.

The fan blade 26 comprises a metal foam 50 and metal workpieces 52 and 54.

In the example shown in FIG. 3 the metal workpieces 52 and 54 define the whole of the shape of the fan blade 26 and the metal workpieces 52 and 54 define a cavity, which contains the metal foam 50 and thus the metal workpieces 52 and 54 enclose the metal foam 50. The metal workpieces 52 and 54 define the leading edge 36, the trailing edge 38, the concave pressure surface 40 and the convex suction surface 42 of the aerofoil portion 35, the radially inner end 44 and the root portion 48. The metal workpieces 52 and 54 are thus integral.

The rotor blades or stator vanes may be made using several different methods.

A metal foam may be manufactured using one of the following methods, gas injection into a molten metal, application of heat to a metallic powder with foaming agent, bonding metallic microspheres using a metallic matrix (a syntactic metal foam), sintering metallic hollow spheres or sintering a mixture of metallic powder and a space holder and then burning out the space holder.

A first method comprises forming metal foam into an aerofoil profile preform having one flat surface and forming two metal workpieces, to length and width, to define the concave wall, convex wall, leading edge and trailing edge of the aerofoil. The metal foam preform is positioned between the two metal workpieces within a die defining the shape of the aerofoil with the ends and edges of the two metal workpieces extending beyond the ends and edges of the metal foam preform. Then the metal foam preform and two metal workpieces are heated to an appropriate temperature and pressure is applied to diffusion bond the metal foam preform to the two metal workpieces and to diffusion bond the ends and edges of the two metal workpieces together and to form the two metal workpieces and metal foam preform into an aerofoil shape with the appropriate camber and twist.

A second method comprises forming metal foam into an aerofoil profile preform with the appropriate camber and twist and forming two metal workpieces with the appropriate camber and twist and to length and width to define the concave wall, convex wall, leading edge and trailing edge of the aerofoil. The metal foam preform is positioned between the two metal workpieces within a die defining the shape of the aerofoil with the ends and edges of the two metal workpieces extending beyond the ends and edges of the metal foam preform. Then the metal foam preform and two metal workpieces are heated to an appropriate temperature and pressure is applied to diffusion bond the metal foam preform to the two metal workpieces and to diffusion bond the ends and edges of the two metal workpieces together. Alternatively the metal foam preform and two metal workpieces may be heated to an appropriate temperature and brazed together.

A third method comprises forming a metal foam preform and machining the metal foam preform into an aerofoil shape with the appropriate camber and twist and forming two metal workpieces with the appropriate camber and twist and to length and width to define the concave wall, convex wall, leading edge and trailing edge of the aerofoil. The metal foam preform is positioned between the two metal workpieces within a die defining the shape of the aerofoil with the ends and edges of the two metal workpieces extending beyond the ends and edges of the metal foam preform. Then the metal foam preform and two metal workpieces are heated to an appropriate temperature and pressure is applied to diffusion bond the metal foam preform to the two metal workpieces and to diffusion bond the ends and edges of the two metal workpieces together. Alternatively the metal foam preform and two metal workpieces may be heated to an appropriate temperature and brazed together.

A fourth method comprises forming two metal workpieces. The two metal workpieces are arranged in a stack within a die with a metallic powder and a foaming agent between the two metal workpieces. The edges of the metal workpieces are sealed together, for example by laser welding or diffusion bonding, brazing etc, to form a sealed assembly. Then heat is applied to produce a metal foam in between the metal workpieces and to form the metal workpieces into an aerofoil shape with appropriate camber and twist in the die.

A fifth method comprises forming two metal workpieces and arranging a stop off material on a surface of one of the metal workpieces. The metal workpieces are arranged in a stack with the stop off material between the two metal workpieces. The edges of the metal workpieces are sealed together, for example by welding, to form a sealed assembly. Then the interior of the sealed assembly is evacuated and then heat and pressure is applied to diffusion bonding the metal workpieces together except where the stop off has been applied to form an integral structure. In the next step heat and pressure is applied to the interior of the integral structure to form a cavity in the integral structure. Then the stop off is removed and the integral structure is placed in a die and a metallic powder and a foaming agent is supplied into the cavity. Heat is applied to produce a metal foam in the cavity and to form the metal workpieces into an aerofoil shape with appropriate camber and twist in the die.

A sixth method comprises forming two metal workpieces and arranging a stop off material on a surface of one of the metal workpieces. The workpieces are arranged in a stack with the stop off material between the two metal workpieces. The edges of the workpieces are sealed together, for example by welding, to form a sealed assembly, then the interior of the sealed assembly is evacuated and then heat and pressure are applied to diffusion bond the metal workpieces together except where the stop off has been applied to form an integral structure. In the next step heat and pressure is applied to the interior of the integral structure to form a cavity in the integral structure and to form the aerofoil shape. Then the integral structure is placed in a die and a metallic powder and a foaming agent is supplied into the cavity. Heat is applied to produce a metal foam in the cavity and to form the metal workpieces into an aerofoil shape with appropriate camber and twist in the die and to bond the metal foam to the metal workpieces. The metal workpieces are preferably formed, twisted, to an aerofoil shape before the metallic powder and foaming powder is introduced to avoid damage to the metal foam. Preferably the metal workpieces are formed, twisted, to an aerofoil shape before the cavity is formed. However, it may be possible to form, twist, the metal workpieces to an aerofoil shape after the metal foam has been introduced into the cavity.

Alternatively, a molten metallic syntactic mix is supplied into the cavity rather than the metallic powder and foaming agent. Alternatively, a metallic powder, or hollow metallic spheres, and a space holder is supplied into the cavity rather than the metallic powder and foaming agent and the metallic powder, or metallic spheres, are sintered together and bonded to the metal workpieces.

A seventh method comprises forming a metal foam preform into an aerofoil shape, forming two metal workpieces and arranging a stop off material on one surface of each of the metal workpieces. The metal workpieces are arranged in a stack with the stop off material between each of the two metal workpieces and the metal foam preform. The edges of the metal workpieces are sealed together, for example by welding, to form a sealed assembly. Then the interior of the sealed assembly is evacuated and then heat and pressure are applied to diffusion bonding the metal workpieces together except where the stop off has been applied to form an integral structure. In the next step heat and pressure are applied to the interior of the integral structure to form a cavity in the integral structure. Then an epoxy binder is introduced into the integral structure to fill the space between the metal foam and the metal workpieces and the epoxy resin is cured to bond the metal foam preform to the metal workpieces.

An eighth method comprises forming a first metal workpiece into a partial aerofoil shape. A second metal workpiece is formed into a partial aerofoil shape to cooperate with the first metal workpiece to form a full aerofoil shape. An aerofoil shaped metal foam preform is formed. Then the first metal workpiece, the metal foam preform and the second metal workpiece are diffusion bonded, brazed, welded or adhesively bonded together.

It may be necessary to machine the radially inner end 44 of the fan blade 26 to form the dovetail root 48 for attachment to the fan rotor 24. It may be necessary to machine the radially inner and radially outer ends 44 and 46 of the fan outlet guide vane 32 to provide bosses for attachment to the fan casing 28 and the core engine casing 33.

The metal foam 50 may be any suitable metal, alloy or intermetallic for example aluminium, nickel, aluminium alloy, magnesium alloy, titanium alloy, nickel alloy, steel, titanium aluminide, nickel aluminide etc.

The metal workpieces 52 and 54 may be any suitable metal, alloy or intermetallic and may be the same metal as the metal foam or preferably may be a different more wear resistant metal.

The hollow metal microspheres are generally compacted under pressure in the die to create the required shape. The hollow metal microspheres may be compacted by hot, or cold, isostatic pressure, forging, rolling, extrusion or injection moulding. The pressure is sufficient to pack down the hollow metal microspheres but is insufficient to crush the hollow metal microspheres. The compacted hollow metal microspheres are then heat treated, sintered, in the controlled atmosphere at a temperature just below the melting point of the metal of the hollow metal microspheres. The temperature, time of treatment and atmosphere may be varied to produce differing mechanical properties and these may be optimised to give the desired mechanical properties. The sintering temperature is typically 50% to 85% of the solidus temperature, melting point, of the metal, alloy or intermetallic dependent upon the properties required.

The metal foam 50 in the cavity of the fan blade 26 shown in FIGS. 2 and 3 ideally has a density of less than 1 g/cm$^3$, 1 gram per cubic centimetre. The fan blade 26 will have greater densities due to the solid metal workpieces 52 and 54. Alternatively the metal foam 50 in the cavity of the fan blade 26 may have a density greater than 1 g/cm$^3$.

For example a fan blade outlet guide vane 32 or a fan blade 26 may comprise titanium alloy foam 50 and a solid titanium alloy workpieces 52 and 54, the titanium alloy may be Ti64, which consists of 6 wt % aluminium, 4 wt % vanadium and the balance titanium plus other minor additions and incidental impurities.

For example titanium alloy Ti64 mentioned above has a melting point of about 1660° C. and hollow titanium alloy microspheres of Ti64 may be sintered at a temperature between 770° C. and 1310° C.

Other examples of titanium alloys are Ti6242, Ti6246 and Ti679. Ti6242 consists of 6 wt % aluminium, 2 wt % tin, 4 wt % zirconium, 2 wt % molybdenum and the balance titanium plus minor additions and incidental impurities. Ti6246 consists of 6 wt % aluminium, 2 wt % tin, 4 wt % zirconium, 6 wt % molybdenum and the balance titanium plus minor additions and incidental impurities. Ti679 consists of 2.2 wt % aluminium, 11 wt % tin, 5 wt % zirconium, 11 wt % molybdenum and the balance titanium plus minor additions and incidental impurities. Hollow Ti6242 microspheres may be sintered at temperatures between 794° C. and 1350° C. Hollow Ti6246 microspheres may be sintered at temperatures between 800° C. and 1360° C. Hollow Ti679 microspheres may be sintered at temperatures between 785° C. and 1335° C.

An example of a nickel alloy is Inco 718, which consists of 19 wt % chromium, 18.3 wt % iron, 5.1 wt % niobium, 3 wt % molybdenum, 0.9 wt % titanium and the balance nickel plus minor additions and incidental impurities. Hollow Inco 718 microspheres may be sintered at temperatures between 630° C. and 1075° C.

An example of an aluminium alloy is RR58, which consists of 2.2 wt copper, 1.wt % magnesium, 1.1 wt % iron, 1.1 wt % nickel and the balance aluminium plus minor additions and incidental impurities. Hollow RR58 microspheres may be sintered at temperatures between 270° C. and 460° C.

An example of a magnesium alloy is RZ5, which consists of 4.2 wt % zinc, 0.7 wt % zirconium and the balance magnesium plus minor additions and incidental impurities. Hollow microspheres of RZ5 may be sintered at temperatures between 255° C. and 435° C.

An example of a steel alloy is Jethete, which consists of 12 wt % chromium, 2.5 wt % nickel, 1.7 wt % molybdenum, 0.4 wt % vanadium and the balance iron plus minor additions and incidental impurities. Hollow microspheres of Jethete may be sintered at temperatures between 720° C. and 1232° C.

The diameters of the hollow metal microspheres are 10 μm to 1000 μm, preferably 30 μm to 200 μm, but larger diameters of hollow metal microspheres may be used. The thickness of the walls of the hollow metal microspheres is about 10% of the diameter of the hollow metal microspheres, about 1 μm for a 10 μm diameter hollow metal microsphere to about 100 μm for a 1000 μm diameter hollow metal microspheres, preferably 3 μm for a 30 μm diameter hollow metal microsphere to about 20 μm for a 200 μm diameter hollow metal microsphere. Alternatively, hollow metal nanospheres may be used which have a diameter of 1 nm to 1000 nm. The diameters and thickness of the walls of the hollow metal microspheres may be varied to optimise mechanical properties.

The compressor vanes may comprise hollow nickel alloy microspheres or hollow steel microspheres. The compressor blades may comprise hollow titanium alloy microspheres or hollow nickel alloy microspheres.

The advantages of the present invention are a reduction in weight of the aerofoil because the metal foam may have a density of less than 1 g/cm$^3$ compared to a density of 2.5 g/cm$^3$ for a hollow aerofoil. The metal foam filled aerofoil has a slightly greater effective density than a prior art diffusion bonded and superplastically formed aerofoil but the metal foam filled aerofoil has improved mechanical integrity because the metal foam has improved fatigue behaviour and impact capability due to the structure created by the metal foam. The aerofoil may have improved damping capability due to the structure created by the metal foam. The metal foam can carry radial loads and provides uniform support to the metal workpieces of the aerofoil during impact and thus the thickness of the metal workpieces can be reduced and hence reduce the weight of the aerofoil. The metal foam is effectively isotropic and provides consistent properties throughout its volume. This means that there are no stress concentrations during normal operation and there is no rippling of the metal workpieces following an impact.

Although the present invention has been described with reference to a fan blade, the present invention is equally applicable to a fan outlet guide vane, a compressor vane or a compressor blade. Thus the term aerofoil is taken to mean any rotor blade or stator vane. In the case of rotor blades it may be necessary to machine the radially inner end of the aerofoil to form a firtree root or a dovetail root.

I claim:

1. A method of manufacturing an aerofoil comprising the steps of: a) forming at least two metal workpieces, b) applying a stop off material to one surface of one of the at least two metal workpieces, c) arranging the at least two metal workpieces in a stack with the stop off material between the two metal workpieces, d) sealing the edges of the at least two metal workpieces together to form a sealed assembly, e) evacuating an interior of the sealed assembly, f) heating and applying pressure to diffusion bond the at least two metal workpieces together except where the stop off has been applied to form an integral structure, g) heating and pressurising an interior of the integral structure to form a cavity in the integral structure, h) placing the integral structure in a die, i) filling the cavity in the integral structure with metal powder and a foaming agent and j) applying heat to produce a metal foam in the cavity in the integral structure and to form the at least two metal workpieces into an aerofoil shape with appropriate twist and camber in the die.

2. A method as claimed in claim 1 wherein the metal foam is selected from the group comprising aluminium foam, titanium foam, nickel foam, titanium alloy foam, aluminium alloy foam, magnesium alloy foam, nickel alloy foam and steel foam.

3. A method as claimed in claim 1 wherein the aerofoil is selected from the group consisting of a rotor blade and a stator vane.

4. A method as claimed in claim 3 wherein the aerofoil is selected to be the rotor blade, and wherein the rotor blade is selected from the group consisting of a fan blade and a compressor blade.

5. A method as claimed in claim 3 wherein the aerofoil is selected to be the stator vane, and wherein the stator vane is selected from the group consisting of a fan outlet guide vane and a compressor vane.

* * * * *